United States Patent [19]

Runkle et al.

[11] 4,343,225

[45] Aug. 10, 1982

[54] FLUID ACTUATOR

[75] Inventors: Dean Runkle, LaPorte; Robert K. Wilson, Granger; William E. Monroe, Syracuse, all of Ind.

[73] Assignee: The Bendix Corporation, Southfield, Mich.

[21] Appl. No.: 155,355

[22] Filed: Jun. 2, 1980

[51] Int. Cl.[3] ..... F01B 7/18; F01L 23/00

[52] U.S. Cl. ..... 91/52; 91/321; 91/343; 91/352

[58] Field of Search ..... 91/343, 341 R, 52, 321, 91/410, 352

[56] References Cited

U.S. PATENT DOCUMENTS 180,664 8/1876 Smith et al. ..... 91/343
1,470,074 10/1923 Gomez ..... 91/343
3,646,849 3/1972 Smith ..... 91/52
4,127,057 11/1978 Stubenruss ..... 91/52

FOREIGN PATENT DOCUMENTS 254881 5/1948 Switzerland ..... 91/343

*Primary Examiner*—Paul E. Maslousky
*Attorney, Agent, or Firm*—Paul David Schoenle; Ken C. Decker

[57] ABSTRACT

A fluid actuator housing (40) supports an output member 56 and a valve assembly (62). The valve assembly controls fluid communication to a pair of chambers (58, 60) to reciprocate the output member within the housing. The first part (64) of the valve assembly directs fluid communication to the chambers and the second part (66) is engageable with the output member to control movement of the first part.

17 Claims, 5 Drawing Figures

FLUID ACTUATOR

The present invention relates to an actuator for moving an output member in response to fluid pressure communicated through a housing. In particular, the output member reciprocates within the housing in response to communication of fluid pressure through the housing.

In a hydraulic system for an automotive vehicle, a power steering pump is coupled to a crankshaft via a pulley of the vehicle engine to generate fluid pressure for operating a brake booster and a power steering gear. In addition, a vacuum pump is coupled to the crankshaft via a pulley to control the operation of automotive accessories, such as heaters, air conditioners, flip-up head lamps, door latches, trunks, antennas and cruise control. The pneumatic system is used for these accessories rather than the hydraulic system because of the economics and size of a pneumatic supply line versus a hydraulic supply line and also because these accessories are already equipped to handle a pneumatic valve rather than a hydraulic value. As a result, the vehicle engine is coupled to two pumps, a power steering pump and a vacuum pump.

If the vehicle engine is a diesel engine, the vacuum generated by an air intake manifold is no longer present so that a vacuum pump is necessary to generate sufficient vacuum to operate the above accessories.

In order to simplify the combined requirements of a hydraulic system and a pneumatic system, the present invention provides an actuator which is integrated into an existing hydraulic supply line for the purpose of generating a vacuum. The actuator housing defines an inlet receiving hydraulic fluid pressure from a power steering gear and an outlet communicating hydraulic fluid pressure to a reservoir of a power steering pump. An output member within the housing is coupled to a vacuum pump which substantially maintains a vacuum within a tank for selective communication with a plurality of accessories. A valve assembly within the actuator housing is engageable with the output member to control communication of hydraulic fluid pressure to chambers defined by the output member. In a neutral position, the valve assembly communicates hydraulic fluid pressure to both chambers to move the output member one way. This one way movement causes the valve assembly to move to a first position wherein hydraulic fluid pressure is communicated to one of the chambers, thereby biasing the output member to move another way. This other way movement causes the valve assembly to return to its neutral position to begin the cycle again. Consequently, the output member reciprocates within the housing in response to hydraulic fluid flow through the housing.

It is an advantageous effect of the invention that the vehicle engine is directly coupled to only one pump and the vacuum pump coupled to the hydraulic actuator provides a vacuum in the absence of a bearing-pulley-belt connection with the vehicle engine. Although the hydraulic actuator consumes energy from the existing hydraulic system, the consumption is believed to be less than that required for the conventional vacuum pump driven by a bearing-pulley-belt. Also, the hydraulic actuator of the invention can be positioned at substantially any location of the hydraulic supply line rather than being limited by a belt connection with a crankshaft of the vehicle engine.

The valve assembly is also provided with a key to permit restricted fluid communication through the housing while the output member is biased to a stationary position. As a result, the output member is responsive to the vacuum level developed by the vacuum pump to cease operation whenever the vacuum level reaches a predetermined value.

The invention is described in detail below with reference to the drawings which illustrate one way of carrying out the invention.

Figure 1:
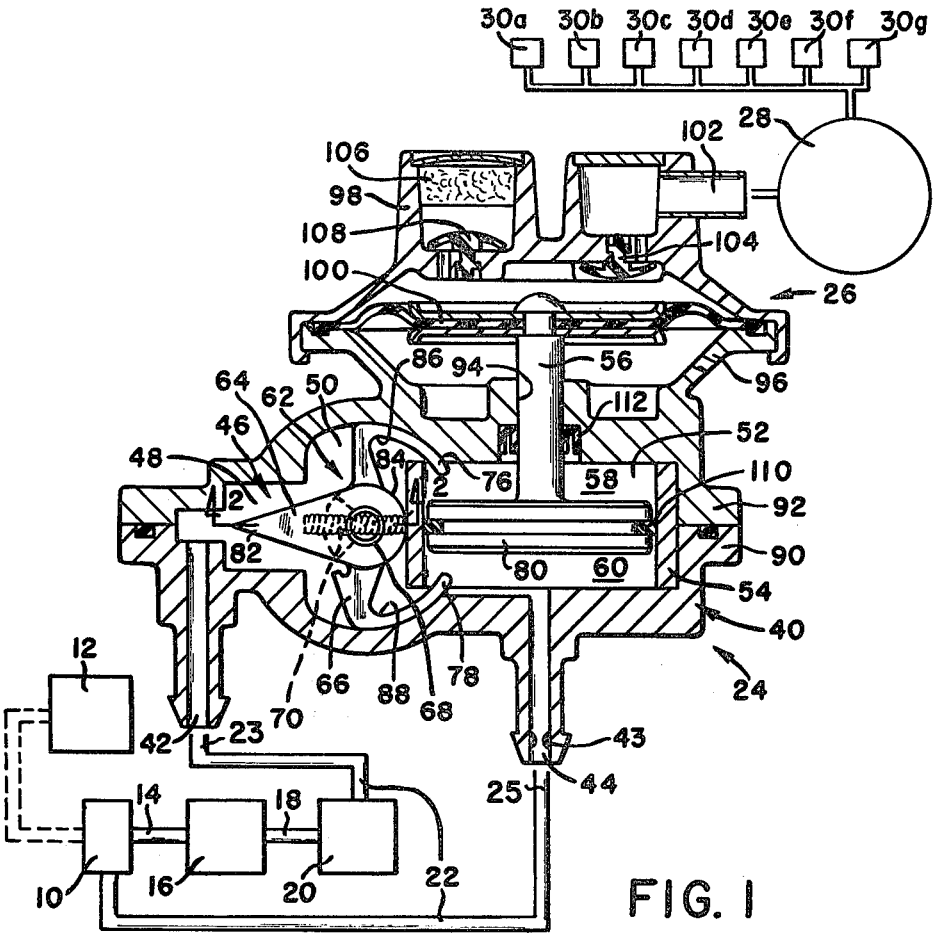
FIG. 1 is a schematic illustration of a hydraulic-pneumatic system for a vehicle with the actuator of the invention shown in cross-section.

In the system of FIG. 1, a power steering pump 10 is coupled via a belt to a vehicle engine 12 for the purpose of generating fluid pressure within conduit 14. Conduit 14 communicates with a hydraulic brake booster 16 so that the fluid pressure therein provides an assist to a braking application and a conduit 18 communicates the fluid pressure exiting from the hydraulic brake booster 16 to a power steering gear 20. A return conduit 22 communicates fluid pressure from the steering gear 20 to a reservoir for the pump 10 via a hydraulic actuator 24 constructed in accordance with the present invention. The return conduit 22 includes an inlet portion 23 for the hydraulic actuator 24 and an outlet portion 25 therefore.

The hydraulic actuator 24 is coupled to a vacuum pump 26 in order to substantially maintain a vacuum within a tank 28. The tank 28 is coupled to a plurality of accessories 30*a* through 30*g*. Upon actuation of the accessories, the vacuum tank 28 is selectively communicated via suitable valve means (not shown) to the actuated accessories to initiate operation of the latter.

The hydraulic actuator 24 defines a housing 40 with an inlet 42 and an outlet 44 with a restriction 43. The inlet 42 leads to a cavity 46. The cavity forms a first portion 48, a second portion 50 which is partially circular in a first plane and a third portion 52 which is substantially circular in a second plane perpendicular to the first plane. A sleeve 54 is disposed within the third portion of cavity 46 and an output member 56 movably and sealingly engages the sleeve to define chambers 58 and 60. The output member 56 is coupled to the vacuum pump 26 and the second portion 50 of cavity 46 receives a valve assembly 62.

The valve assembly 62 comprises a first part 64 and a second part 66 which are connected via a pin 68. The first part 64 is dimensioned to substantially extend across the cavity 46 so that fluid communication can only occur over the top and bottom of the first part and past the second part to the chambers 58 and 60. A spring 70 connected to the parts resiliently opposes rotation between the parts about the pin. A pair of fingers 76 and 78 formed on the second part extend into the respective chambers 58 and 60 to oppose a disc 80 formed by the output member 56. The first part 64 terminates in a pointed end 82 disposed within the first portion 48 of cavity 46 so that the end 82 can be related to oppose the wall of first portion 48. The first part 64 forms a circular edge 84 opposite the pointed end 82 to slidably engage the sleeve 54, whereas the second part fingers 76 and 78 define undercut recesses 86 and 88 for receiving the sleeve 54.

The housing 40 is formed by a pair of plates 90 and 92 which are recessed at the interface therebetween to define the cavity 46. The plate 90 also includes the inlet and outlet, while the plate 92 can also be provided with an outwardly extending shell 96 which cooperates with a matching shell 98 to sealingly carry a diaphragm 100. The output member is secured to the diaphragm to move the latter between the shells. The shell 98 includes a port 102 communicating with the tank 28 via a check valve 104. A secondary port 106 communicates with the atmosphere via a check valve 108.

Figure 4:
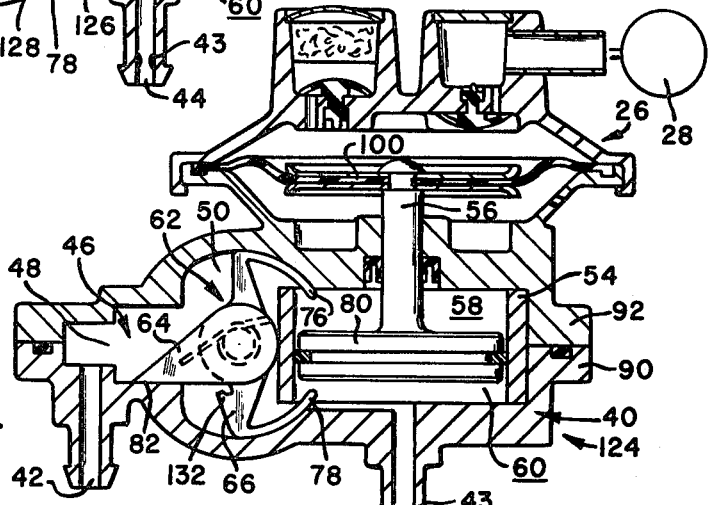

When the vehicle engine 12 is running, the power steering pump 10 is communicating pressurized hydraulic fluid through the conduits 14, 18 and 22 so that the brake booster 16, power steering gear 20 and actuator 24 are receiving hydraulic fluid pressure. Fluid enters the actuator 24 via inlet 42 and is communicated past the valve assembly to the chambers 58 and 60 before it exhausts through the restricted outlet 44. The chambers are open to each other via the second portion 50 and the sleeve opening which receives the fingers 76 and 78, so that the fluid pressure within one chamber is substantially equal to the fluid pressure within the other chamber when the valve assembly 62 is in a neutral position even though the chamber 60 is directly opened to the restricted outlet 44. In view of the sealing engagement between the output member and sleeve at 110 and between the output member and housing at 112, the output member defines a differential area between both sides thereof so that substantially equal pressure in both chambers 58 and 60 will bias the output member to move upwardly. Upward movement of the output member 56 engages the disc 80 with the finger 76 to rotate the second part 66 of valve assembly 62 counter-clockwise. The spring 70 is also rotated to rotate the first part 64 counter-clockwise until the end 82 abuts the wall of first portion 48; see FIG. 4. In this position, the inlet is closed from the outlet and also substantially closed from the chamber 60 although slight leakage does occur past the edge 84 and sleeve 54. As a result, the fluid pressure in chamber 58 biases the output member to move downward. This downward movement of the output member moves the disc 80 downward into engagement with the finger 78 to rotate the second part of the valve assembly clockwise. Because the flow of fluid to chamber 58 and edge 84 over the top of the first part 64 imparts a downward force on part 64, the second part 66 will rotate clockwise to rotationally load the spring 70. When the rotational load biasing the first part to rotate clockwise is sufficient to overcome the downward force of the fluid flow, the first part 64 will rotate clockwise opening the outlet to the inlet as well as opening both chambers to the inlet again. Substantially equal pressures in both chambers causes the output member to move upwardly to continue the cycle so that the output member is reciprocated within the housing.

With the output member oscillating relative to the housing, the diaphragm 100 of pump 28 is also oscillating between the shells 96 and 98 so that air within tank 28 is withdrawn and released to atmosphere in order to maintain a vacuum within the tank.

Figure 2:
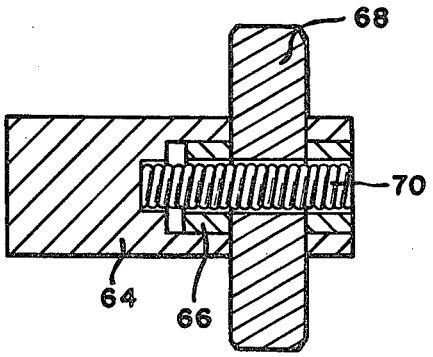
FIG. 2 is an exploded view of the valve assembly used in the actuator of FIG. 1.
Figure 3:
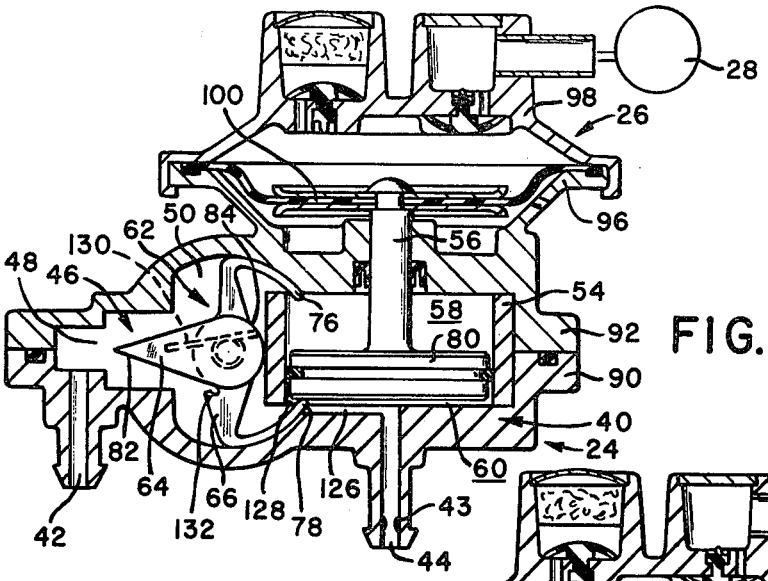
FIGS. 3–5 show the operative positions for the actuator utilized in the system of FIG. 1.

As shown in FIG. 3, the Actuator 24 aligns the outlet 44 with the output member 56 so that the outlet leads to the chamber 60. A slot 126 extends transversely from the outlet 44 to the cavity portion 50 via an opening 128 formed between the sleeve 54 and the housing to receiver finger 78. The coil spring 70 of FIGS. 1 and 2 is replaced by a torsion spring 130 in FIG. 3; however, the function of each spring is the same. The second part 66 includes a key 132 integrally formed thereon. The key 132 extends transversely from the second part 66 to oppose the first part 64.

Figure 5:
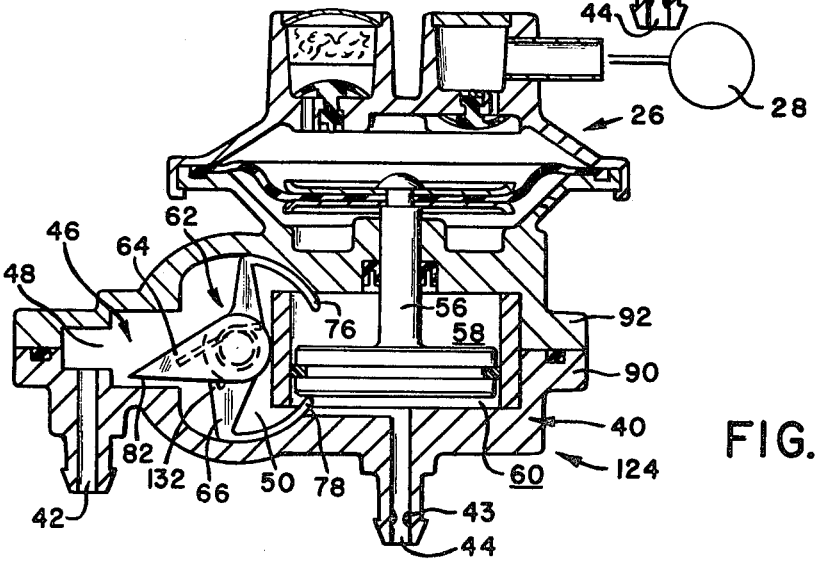

With the valve assembly in the position illustrated in FIG. 3, fluid pressure within chambers 58 and 60 will move the output member 56 upward to cause the disc 80 to move the finger 76 to rotate counter-clockwise. The rotation of finger 76 causes the first part 64 to rotate counter-clockwise via spring 130 to the position shown in FIG. 4 in abutment with the housing 40 adjacent cavity portion 48. Fluid pressure is thereby communicated solely to the chamber 58 while the chamber 60 is in communication with the outlet. The fluid pressure in chamber 58 biases the output member 56 to move downwardly until the disc 80 engages the finger 78. The downwardly moving disc 80 will cause the finger 78 to rotate clockwise, thereby biasing the first part 64 to also rotate clockwise. However, the fluid pressure across the top of the first part 64 forces the first part to remain in the position of FIG. 4. If the vacuum force across diaphragm 100 is less than a predetermined force, the output member 56 will be biased to continue moving downward to substantially engage the bottom wall of the chamber 60. As a result, the torsion spring 130 will be loaded sufficiently to offset the fluid pressure forces against end 82 to rotate the first part 64 clockwise away from the housing 40 to a position illustrated in FIG. 3. However, if the vacuum force across diaphragm 100 is equal to the predetermined force, the output member 56 will move downward to the position of FIG. 5 wherein the forces on the output member by the vacuum across the diaphragm, the pressures in chamber 58 and in chamber 60 against the disc 80 will be substantially equal. In this position, the key 132 is engaged with the first part 64 to hold the latter slightly spaced from the housing. The force imparted by the key to the first part is substantially equal to the force of the fluid pressure across the top of the first part 64. In this equilibrium position, the pump 26 is stalled out due to the vacuum level reached within the tank 28. When the vacuum level is reduced, the forces across diaphragm 100 biasing the same upward will be reduced so that the disc 80 will move downward to further rotate part 64 away from housing 90 to equate the fluid pressure in chambers 58 and 60. As a result, the output member will move upward in view of the fluid pressure across the differential area of output member 56 to initate the motion of the vacuum pump 26.

As described above, the valve assembly 62 is provided with a key 132 which cooperates with the output member 56 to stall the pump 26 whenever a desired vacuum is reached within tank 28. As a result, the pump and actuator will only operate when the tank 28 requires further vacuuming. Also, in the stalled condition, the actuator continues to communicate fluid from the inlet 42 to the outlet 44, albeit through a restricted passage between the part 64 and the housing. The restricted passage is controlled by the engagement of the key 132 and the part 64.

Although many further modifications and/or changes to the invention herein described are feasible by one skilled in the art, it is intended that these modifications and/or changes are included within the scope of the appended claims.

We claim:

1. In an actuator;

a housing having an inlet and an outlet for communicating a pressurized fluid through said housing;

an output member movable relative to said housing and exposed to the pressurized fluid therein; and a valve assembly movable within said housing from a first position to a second position, said valve assembly substantially closing communication from the inlet to the outlet in the first position, said valve assembly communicating fluid pressure to one side of said output member to cause the latter to move in a first direction relative to the housing, said output member being movable in the first direction to engage said valve assembly to move the latter away from the first position toward the second position, said valve assembly communicating fluid pressure to another side of said output member to cause the latter to move in a second direction relative to the housing, said output member being movable in the second direction to engage said valve assembly to move the latter away from the second position toward the first position, and said output member defining a differential area between opposite sides thereof such that communication of fluid pressure to both sides of said output member bias the latter to move away from a neutral position.

2. The actuator of claim 1 in which said valve assembly comprises a first part directing fluid pressure to either side of said output member and a second part engageable with said output member, said first part and said second part being connected to yieldably permit rotation between said parts.

3. The actuator of claim 1 in which a cylindrical sleeve is disposed within said housing, said output member movably engaging said cylindrical sleeve to define a pair of pressure chambers and said valve assembly is movable by said output member to selectively communicate fluid pressure to said pair of pressure chambers.

4. The actuator of claim 3 in which said cylindrical sleeve cooperates with said housing to define a pair of apertures communicating with said pair of pressure chambers.

5. The actuator of claim 4 in which said valve assembly includes a pair of fingers extending into said pair of pressure chambers to oppose said output member.

6. In an actuator having a housing with an inlet and an outlet for communicating fluid through the housing, an output member movably disposed within the housing and a valve assembly responsive to the flow of fluid through the housing to control the movement of the output member relative to the housing, characterized by said output member being engageable with said valve assembly to move the latter from a first position to a second position, said valve assembly communicating fluid to one side of said output member in said first position to move the latter in one direction relative to said housing, and said valve assembly communicating fluid to both sides of said output member in said second position to move the latter in another direction relative to said housing whereby said valve assembly oscillates between said first and second positions in response to said output member moving within said housing.

7. The actuator of claim 6 in which said valve assembly substantially terminates communication between said inlet and said outlet in said first position.

8. The actuator of claim 6 in which said valve assembly comprises a first part controlling communication of fluid from said inlet to said output member and a second part engageable with said output member.

9. The actuator of claim 8 in which said first part and said second part are connected to permit rotation therebetween and a resilient member yieldably opposes said rotation.

10. The actuator of claim 6 in which said output member and said valve assembly define a spacing therebetween to permit said output member to move a limited amount relative to said valve assembly.

11. The actuator of claim 6 in which said output member is exposed to said outlet regardless the position of said valve assembly.

12. In an actuator having a housing with an inlet and an outlet for communicating fluid pressure through the housing, an output member movably disposed within the housing and a valve assembly cooperating with the output member to control movement of the latter, characterized by said output member cooperating with said housing to define a differential area between opposite sides of said output member, said differential area being exposed to the fluid pressure within said housing to bias said output member to move from a neutral position in a first direction relative to said housing, said first direction movement of said output member moving said valve assembly from a neutral position to a first position substantially closing communication of fluid pressure to one side of said output member, said valve assembly in the first position communicating fluid pressure to the other side of said output member to bias said output member to return to its neutral position, and said valve assembly being engageable with said output member to return to its neutral position in response to movement of said output member toward its neutral position.

13. The actuator of claim 12 in which said valve assembly comprises a first part controlling communication of fluid pressure to said output member and a second part engageable with said output member.

14. The actuator of claim 13 in which said first part and said second part are rotatably connected and a resilient member yieldably permits rotation therebetween.

15. The actuator of claim 12 in which said valve assembly defines a pair of fingers and said output member extends between said pair of fingers and is movable therebetween.

16. In an actuator having a housing with an inlet and an outlet, an output member movable relative to the housing in response to communication of fluid pressure from the inlet to the outlet, the output member being movable to generate an output force, and a valve assembly disposed within the housing intermediate the inlet and the outlet, the valve assembly cooperating with the output member to control communication of fluid pressure to opposite sides of the output member, characterized by said output member being engageable with said valve assembly to move the latter within said housing and said valve assembly including means to maintain said valve assembly and said output member in a stalled position wherein fluid pressure is communicated from said inlet to said outlet and said valve assembly and said output member are substantially stationary within said housing when the output force reaches a predetermined valve, said output member cooperating with said housing to define a pair of chambers, and said housing forming a slot opening to one of said pair of chambers and said valve assembly extends into said slot.

17. The actuator of claim 16 in which said valve assembly comprises a first part and a second part, said first part being rotatable relative to said second part, and said means limits the degree of rotation between said parts.

* * * * *